US006869361B2

(12) United States Patent
Sharpless et al.

(10) Patent No.: US 6,869,361 B2
(45) Date of Patent: Mar. 22, 2005

(54) SYSTEM, APPARATUS AND METHOD EMPLOYING CONTROLLER FOR PLAY OF SHARED BONUS GAMES

(75) Inventors: David J. Sharpless, Henderson, NV (US); Jason R. deGrandmaison, Las Vegas, NV (US); Julie A. Mottes, Henderson, NV (US); Michael T. Tessmer, Bozeman, MT (US)

(73) Assignee: IGT, Reno, NV (US)

( * ) Notice: Subject to any disclaimer, the term of this patent is extended or adjusted under 35 U.S.C. 154(b) by 336 days.

(21) Appl. No.: 09/998,927

(22) Filed: Nov. 29, 2001

(65) Prior Publication Data

US 2003/0100361 A1 May 29, 2003

(51) Int. Cl.[7] ..... A63F 9/22

(52) U.S. Cl. ..... 463/25; 463/20; 463/42

(58) Field of Search ..... 463/16–20, 25–27, 463/40, 43; 273/138.1, 138.2, 139, 143 R

(56) References Cited

U.S. PATENT DOCUMENTS

| | | | | |
|---|---|---|---|---|
| 4,710,873 A | | 12/1987 | Breslow et al. | 364/410 |
| 4,837,728 A | | 6/1989 | Barrie et al. | |
| 5,560,603 A | | 10/1996 | Seelig et al. | |
| 5,655,961 A | | 8/1997 | Acres et al. | |
| 5,664,998 A | | 9/1997 | Seelig et al. | |
| 5,769,716 A | | 6/1998 | Saffari et al. | |
| 5,779,544 A | | 7/1998 | Seelig et al. | |
| 5,848,932 A | | 12/1998 | Adams | |
| 5,851,148 A | | 12/1998 | Brune et al. | |
| 5,855,515 A | | 1/1999 | Pease et al. | |
| 5,876,284 A | | 3/1999 | Acres et al. | |
| 5,902,983 A | | 5/1999 | Crevelt et al. | |
| 5,911,418 A | | 6/1999 | Adams | |
| 6,048,269 A | | 4/2000 | Burns et al. | |
| 6,086,477 A | * | 7/2000 | Walker et al. | 463/17 |
| 6,089,976 A | | 7/2000 | Schneider et al. | |
| 6,089,978 A | | 7/2000 | Adams | |
| 6,146,273 A | | 11/2000 | Olsen | |
| 6,168,523 B1 | | 1/2001 | Piechowiak et al. | |
| 6,190,255 B1 | | 2/2001 | Thomas et al. | |
| 6,217,448 B1 | * | 4/2001 | Olsen | 463/25 |
| 6,224,484 B1 | | 5/2001 | Okuda et al. | 463/27 |
| 6,364,765 B1 | * | 4/2002 | Walker et al. | 463/16 |
| 6,368,216 B1 | * | 4/2002 | Hedrick et al. | 463/20 |
| 2001/0036855 A1 | | 11/2001 | DeFrees-Parrott et al. | 463/17 |
| 2002/0177483 A1 | * | 11/2002 | Cannon | 463/42 |

FOREIGN PATENT DOCUMENTS

| | | |
|---|---|---|
| WO | WO 01/80057 | 10/2001 |

OTHER PUBLICATIONS

Jim Kilby, Casino Operations Management, John Wiley & Sons, Inc., 1998, pp. 107, 108, 113.*
International Search Report (counterpart PCT application).

* cited by examiner

*Primary Examiner*—Mark Sager
*Assistant Examiner*—Steven Ashburn
(74) *Attorney, Agent, or Firm*—Marshall, Gerstein & Borun LLP

(57) ABSTRACT

The present invention includes a system, apparatus and method for providing a bonus game which may be shared competitively, collaboratively or both among a plurality of players. Each player participating in the bonus game generates entries thereto in association with play of a base, or primary, game played on an individual gaming device. Players may also reintroduce entries for the bonus game that were generated on a gaming device at an earlier time to a different gaming device. Each gaming device is in communication with a controller that operates the shared bonus game and may communicate with or integrate a player tracking system. During the shared bonus game, the controller is configured to randomly select a bonus award amount that may be consistent with the par sheets, or pay tables, associated with the gaming devices, or separate therefrom. The controller is also configured to randomly select a winning entry from among all of the qualified entries and provide the bonus award amount to the player that placed the winning entry.

22 Claims, 8 Drawing Sheets

SYSTEM, APPARATUS AND METHOD EMPLOYING CONTROLLER FOR PLAY OF SHARED BONUS GAMES

BACKGROUND OF THE INVENTION

1. Field of the Invention

The present invention relates generally to gaming devices and methods. More specifically, the present invention relates to gaming methods, devices and systems enabling player participation in a bonus event shared competitively, collaboratively or both with at least one other player, while accommodating base game as well as bonus game play by a single player until joined by the at least one other player.

2. State of the Art

Games of chance have been enjoyed by people for thousands of years and have enjoyed widespread popularity in recent times. Many people enjoy playing a wide variety of games that they have not played before. Playing new games adds to the excitement of this recreational activity, particularly when some form of "gaming" is involved. As used herein, the terms "gaming" and "gaming devices" are used to indicate that some form of wagering is involved, and that players must make wagers of value, whether actual currency or some equivalent of value, e.g., token or credit.

One popular gaming device that has long been enjoyed by many players is the slot machine. FIG. 1 is a perspective view of a slot machine 10 as described in U.S. Pat. No. 5,848,932 to Adams (Dec. 15, 1998), which is assigned to the assignee of the present invention and the disclosure of which is incorporated herein by reference. A slot machine 10 typically includes rotatable reels 60, each having a plurality of symbols thereon that are randomly displayed when a mechanical lever 12 is pulled and the reels 60 are rotated. If the symbol displayed is a predefined symbol, or predefined combination of symbols, the player may receive a payout either through coin chute 20, which deposits winnings into coin trough 30, or by increasing the player's credits displayed in credit window 40. One skilled in the art will recognize that a slot machine 10 may also include a microprocessor, or other central processing unit as well as memory. In such a case, a display screen (not shown) (e.g., a cathode ray tube (CRT), plasma display, liquid crystal display (LCD), and/or a display based on light-emitting diodes (LED)) may be operably coupled to the computer to replace the reels 60 and provide a simulation of reels and their rotation, the output of a random number generator being used to direct the types and combinations of symbols displayed on the display screen, all as known in the art.

A coin slot 14, currency validator 16 or card acceptor device 18 (to accept a credit card, gaming card, player card, smart card and the like) permits a player to activate a "base game" on the slot machine 10. As used herein, "base game" or "primary game" refers to a primary game played on the gaming device for which a player may wager directly upon the outcome. One skilled in the art will recognize that a player will have a predefined chance, or odds, of winning a payout for the base game based on the mathematical odds that a winning symbol or combination of symbols will be randomly displayed on the indicia of the reels 60. As used herein, "payout," "payback" and "percentage payback" are synonymous. The odds may be adjusted by changing the number of possible non-winning symbols or combination of nonwinning symbols in relation to the number of possible winning symbols or combination of winning symbols. Typically, the odds of winning a payback and the amount to be awarded to a winning player in relation to the amount wagered is defined in the form of a "paytable" or "par sheet."

As noted above, initiating a base game on a slot machine 10 may be done as simply as by inserting a coin, token or other type of currency equivalent (debit card or credit card) into a gaming device such as slot machine 10. Another example of a player action which may be taken in initiating a base game includes inserting an identification card, such as a "smart card," having a programmed microchip or a magnetic strip coded with a player's identification, credit totals and other relevant information. Such smart cards or "player cards" may be used in player tracking systems as in, for example, U.S. Pat. No. 5,769,716 to Saffari et al. (Jun. 23, 1998), which discloses a card that contains information about the player which is pertinent to the gaming activity such as points awarded based upon the player's gaming activity. In the Saffari et al. patent, the player inserts the card in a gaming device at the time of play. When the player indicates that he or she has finished play on that gaming device, the card is updated with player activity information. The player can then insert the card into a different gaming device, which makes the player activity information stored on the card available to the player tracking system. It is also known to accept preprinted coupons, or cash out slips, to initiate a base game and to print the cash out slips directly from a gaming device as described in U.S. Pat. No. 6,048,269 to Burns et al. (Apr. 11, 2000). Additionally, it is known to transfer money to a game through an electronic funds transfer process as described in U.S. Pat. No. 5,902,983 to Crevelt et al. (May 11, 1999).

Existing gaming device displays may include multiple images representing various aspects of a game such as a game portion, a credit total portion and a wager amount portion. Other displays include an additional bonus award portion to indicate an amount of a bonus award which may be won, typically through multiple or secondary games. See U.S. Pat. No. 5,851,148 to Brune et al. (Dec. 22, 1998) and U.S. Pat. No. 5,911,418 to Adams (Jun. 15, 1999).

In addition to the gaming activity described above, it is also possible to participate in a game of chance via the Internet. This is typically accomplished through a casino or game host site offering displays similar to those found in conventional gaming devices. Generally, to play a game of chance via the Internet, a software file is downloaded to a player's computer or terminal, which may then be used to install the necessary software for the game and access the casino or game host Internet site. As with a conventional gaming device, Internet games may be accessed using an identification code or name to identify the specific player and retrieve that player's credit total or play history.

Bonus gaming, also known in the art, includes employing a secondary game that will typically execute if the player achieves a predefined outcome associated with the base game. In many cases, the bonus game is a singular event in that the play changes to the bonus game when a certain base game outcome is achieved and the bonus game is then played to completion. For example, as depicted in FIG. 1 and as disclosed in the aforementioned U.S. Pat. No. 5,848,932, when the reels 60 of the slot machine 10 stop on certain predetermined indicia, a bonus game may be initiated by pressing a button 50 and bonus indicator 70 actuated to display a randomly determined bonus award. (See also, U.S. Pat. No. 6,089,978 to Adams (Jul. 18, 2000) disclosing a gaming system wherein displaying a certain indicator on the reels of a primary slot machine enables a secondary game allowing a player to spin a wheel to determine a payout amount for the secondary game.) In other cases, the bonus game is a more sequential event in that progress through the bonus game is determined by continued play in the base game.

One type of bonus game is described, for example, in U.S. Pat. No. 6,190,255 to Thomas et al. (Feb. 20, 2001). In one version, the possible primary game outcomes include a special symbol combination that causes a computer processor to generate a bonus game resource exercisable in the bonus game. For example, one or more bonus game resources can be used to override the end-bonus outcome and thereby allow the play of the bonus game to continue.

Another type of bonus game is described, for example, in U.S. Pat. No. 6,089,976 to Schneider et al. (Jul. 18, 2000). One disclosed version allows the player to have further interaction in the bonus game by providing a touch screen where the player can select objects by touching the screen positions. Various values are then revealed to the player until an end-bonus outcome is encountered.

Bonus gaming may also be conducted through a plurality of networked, or linked, gaming devices such that the secondary gaming activity might involve a plurality of players wagering on base games at separate gaming devices. Some examples of bonus gaming wherein a player may compete with a plurality of other players for a secondary prize include U.S. Pat. No. 5,779,544 (Jul. 14, 1998), U.S. Pat. No. 5,664,998 (Sep. 9, 1997) and U.S. Pat. No. 5,560, 603 (Oct. 1, 1996) all to Seelig et al. The Seelig et al. patents describe variations on a bonus game wherein the bonus game may include one or more contestants in a race. In one embodiment, each player wagering at a primary gaming unit may be represented by a particular contestant in the race. The contestant representing a particular player advances in the race according to the represented player's gaming activity at the primary gaming unit. The race ends upon a contestant finishing or upon the expiration of a predetermined amount of time, whichever comes first. A disadvantage of the Seelig et al. patents is that, while enticing players to compete against one another for a prize by placing larger and more frequent wagers on a base game than other players, it is impossible to maintain a percentage payback at any one gaming device that is consistent with the par sheet for that device. For example, a slower player may receive a lower percentage payback than indicated on the par sheet of the device while a faster player may receive a higher percentage payback than indicated. Thus, a percentage payback displayed on the par sheet of any one gaming device may be inaccurate and misleading.

Other examples of bonus games including a plurality of networked primary gaming devices include U.S. Pat. No. 6,146,273 to Olsen (Nov. 14, 2000), U.S. Pat. No. 5,876,284 to Acres et al. (Mar. 2, 1999) and U.S. Pat. No. 6,168,523 to Piechowiak et al. (Jan. 2, 2001). The Piechowiak et al. patent, for example, describes a system of linked gaming devices wherein the generation of certain symbols at each gaming device is used to build up a pooled bonus value. A bonus award is then awarded to the player that causes the accumulated bonus value to meet or exceed a predetermined value. Like the Seelig et al. patents, the Piechowiak et al. patent does not allow any one gaming device to maintain a percentage payback consistent with the par sheet for that device. Indeed, it appears that faster players or players employing strategy in deciding when to wager on a base game will have an advantage which will skew the percentage payback of each gaming device participating in the bonus game.

Gaming systems have also included progressive systems in which the bonus award amount increments as base games are played on individual or linked gaming devices. One type of progressive gaming system is described, for example, in U.S. Pat. No. 4,837,728 to Barrie et al. (Jun. 6, 1989). In the Barrie et al. patent, a game controller is connected to a plurality of machines. A win is generated approximately every one half minute (every eight handle pulls), adding to the progressive bonus pool. Accordingly, the value of the progressive bonus rapidly increments and player enthusiasm is generated. Because a coin drop freezes a progressive bonus amount on a particular machine, the player knows the value being played for. Another type of progressive gaming system is described, for example, in U.S. Pat. No. 5,855,515 to Pease et al. (Jan. 5, 1999). In this example, the progressive prize is not limited to an individual gaming device or terminal by permitting use of a hierarchically organized gaming system which consists of gaming terminals within a plurality of casinos controlled by a central system. When the central system has determined that the prize has been won, the casino whose "chance" resulted in the win will award the entire prize to a randomly selected player having a player card inserted into a gaming device. (See also U.S. Pat. No. 5,655,961 to Acres et al. (Aug. 12, 1997) disclosing multiple gaming devices linked to a progressive jackpot.)

While various gaming systems and methods for providing bonus games shared among multiple gaming devices have been proposed, none appear to allow players to compete directly against another player or for the players to act in collaboration with one another to win a prize. As discussed above, it would be advantageous to provide a shared bonus game while maintaining a percentage payback consistent with a par sheet corresponding to each device.

BRIEF SUMMARY OF THE INVENTION

The present invention comprises a system, apparatus and method providing a bonus game architecture for shared competitive, collaborative or both types of bonus gaming among a plurality of players.

A method of operating a shared bonus game in accordance with the present invention includes generating entries for the shared bonus game, detecting a bonus game trigger and executing the shared bonus game in order to determine a bonus award amount. A payout is provided for a winning entry that is randomly selected from among all of the entries for the shared bonus game. The method may also include providing the payout consistent with a par sheet for the gaming device that generated the winning entry.

A method of tracking a player's participation in a plurality of shared bonus games in accordance with the present invention includes detecting current entries generated by the player using a gaming device during a current bonus round, detecting a triggering event indicating the start of a current bonus game, querying if the player is eligible to participate in the current bonus game and, if yes, including the current entries in a current entry pool. The method also includes detecting the completion of the current bonus game and clearing all entries from the current entry pool before detecting a next bonus round.

A gaming device includes a random number generator configured to select a random combination of symbols during a base game and at least one display electronically coupled to the random number generator configured for exhibiting the random combination of symbols signifying the base game outcome. The at least one display is also configured for exhibiting a bonus game controlled by the gaming device and playable by a single player in a first mode of operation and for exhibiting a shared bonus game controlled by an external controller in a second mode of operation. In the second mode, the display at least indicates a randomly selected winner of the shared bonus game.

A controller for providing a shared bonus game of a competitive or collaborative configuration includes a memory device with at least one par sheet stored in the memory device and a microprocessor electrically coupled to the memory device. The microprocessor is configured for executing a shared bonus game for at least one external gaming device electrically connected to the controller. The microprocessor is also configured for selecting at least one winner of the shared bonus game by randomly selecting at least one winning entry from an entry pool.

A gaming system in accordance with the present invention includes a controller configured to provide a shared bonus game and gaming devices in communication with the controller. The gaming devices are each configured to generate entries for the bonus game. The gaming system also includes a primary bonus game indicator in communication with the controller. The primary bonus game indicator is configured to at least identify a randomly selected winner of the shared bonus game.

The system, apparatus and method of the present invention is not limited to play of a specifically configured bonus game but provides a gaming architecture for shared play of a bonus game wherein a plurality of players may compete against one another, collaborate with each other, or both collaborate and compete with respect to one another to win the bonus game.

The system, apparatus and methods of the present invention will be readily understood by reading the following detailed description in conjunction with the accompanying figures of the drawings.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 2:
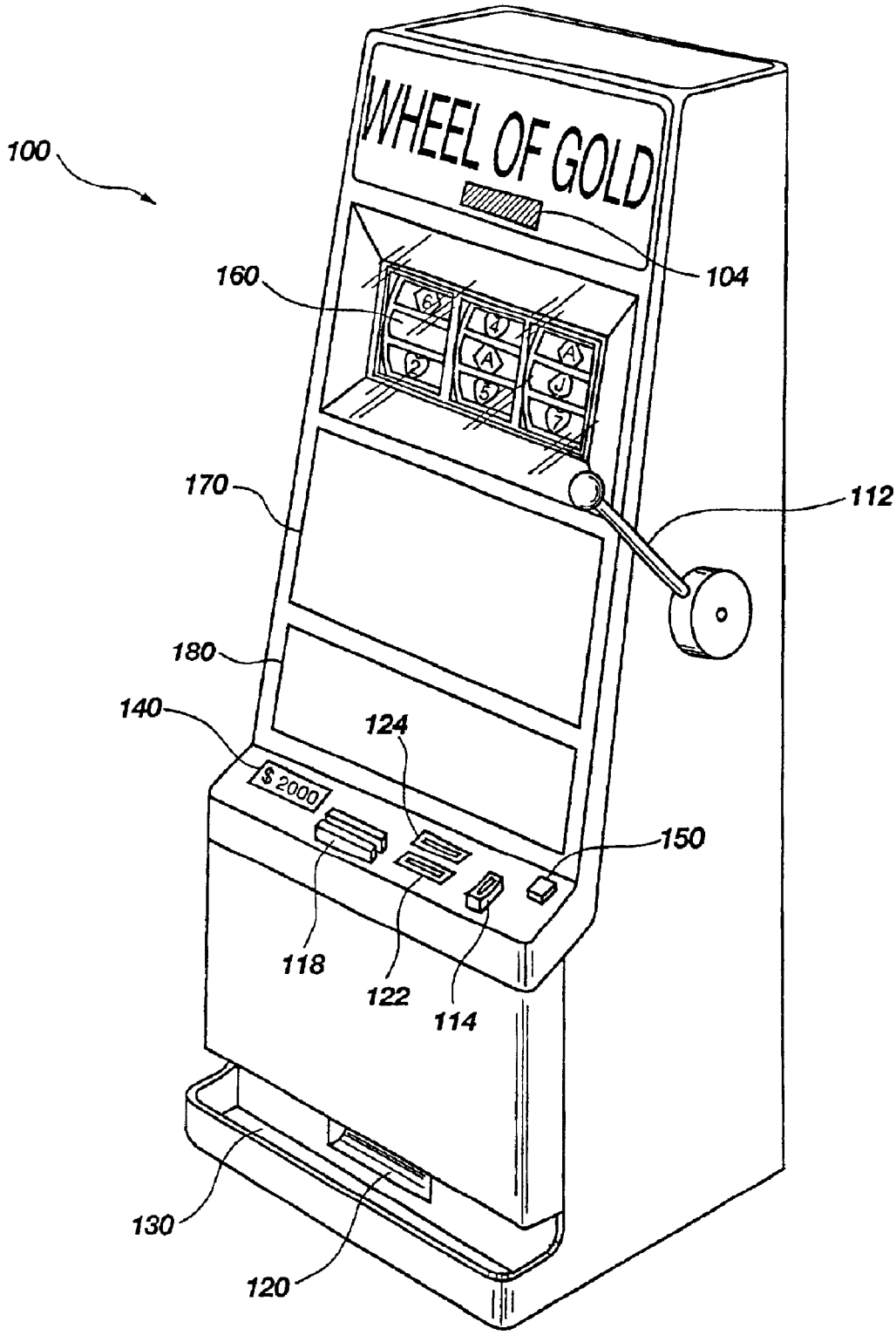
FIG. 2 is a perspective view of a gaming device according to the present invention.

FIG. 2 is a perspective view of an exemplary gaming device 100 in accordance with the present invention. Gaming device 100 includes a base game indicator 160 operably connected to a random number generator (not shown) configured to select a random combination of indicia on the base game indicator 160. Thus, gaming device 100 may be configured as one of any of a number of electronic or electro-mechanical gaming devices utilizing a random number generator to produce an outcome. Base game indicator 160 may, by way of example only, be configured to display a reel-type game, card game or any other game of chance consisting of a substantially random outcome. Physical reels or other elements may be employed, or base game indicator 160 may comprise a video display of any of the types previously mentioned herein.

Gaming device 100 also includes a bonus game indicator 170, which, in a first mode, is configured to exhibit a bonus game controlled by gaming device 100. Thus, in the first mode, a random number generator employed in connection with the bonus game (which may be the same as that employed with the base game or another, as known in the art) may randomly select a symbol, combination of symbols or award amount. In a second mode, the bonus game indicator 170 is configured to exhibit a shared bonus game controlled by an external controller (not shown in FIG. 2,) such as controller 190 discussed in relation to FIG. 4 below, electrically connected to a communication device (not shown) within gaming device 100. The communication device may be a modem or network card, as is known in the art, which is configured to communicate with the external controller directly or indirectly (such as via an Internet service provider (ISP) through the Internet). An interface card may be used to adapt various makes and models of gaming devices 100 for shared bonus game play.

Gaming device 100 may include a camera selectively positioned so as to acquire an image of a player actively using gaming device 100. To this end, the camera may be positioned within the gaming device 100 behind camera window 104, which reference numeral is also employed to designate the camera in FIG. 2. The camera may be configured to selectively acquire still or moving (e.g., video) images and may be configured to acquire the images in either an analog or digital format. The camera may be configured to be controlled by gaming device 100 in the first mode and by the external controller in the second mode. Gaming device 100 may include at least one additional indicator 180 configured to display the image acquired by the camera 104. Alternatively, bonus game indicator 170 may be configured to display the image acquired by the camera as well as display the visible manifestation of the bonus game in split screen or picture-in-picture fashion. The at least one additional indicator 180 may be alternatively configured to exhibit an amount accumulated in a progressive bonus pool.

Figure 3:
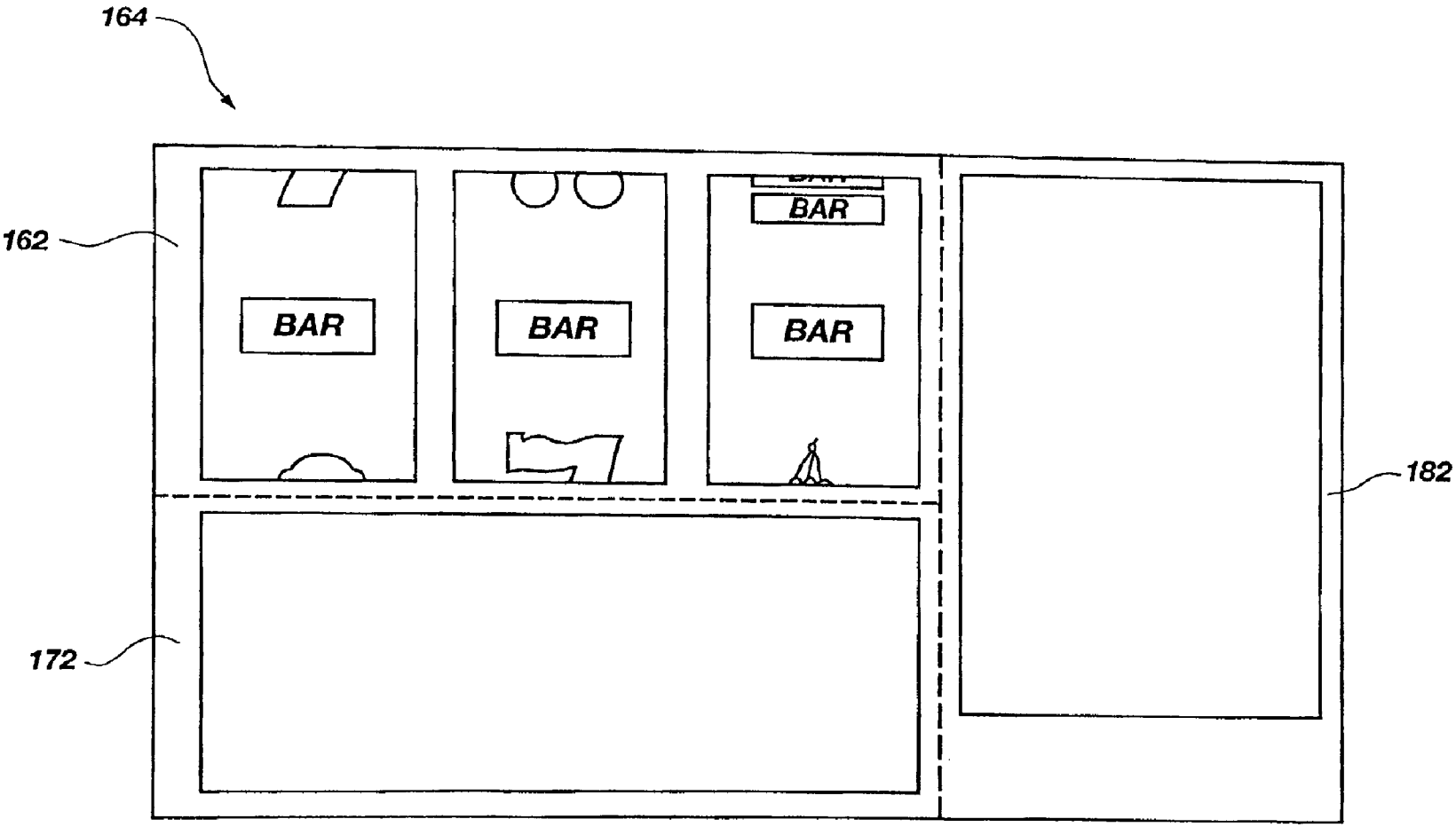
FIG. 3 is an embodiment of an exemplary gaming device display according to the present invention.

As an alternative to individual indicators 160, 170 and 180, gaming device 100 may include a gaming device display 164 as depicted in FIG. 3. Gaming device display 164 may comprise, without limitation, a monitor, such as a computer monitor, a television display or any other device configured to display an image. By way of example only, suitable display technologies may include cathode ray tube (CRT) displays, plasma displays, liquid crystal displays (LCD) and light-emitting diode (LED) displays. As shown in FIG. 3, gaming device display 164 may comprise a plurality of windows or display segments 162, 172 and 182 (separated in FIG. 3 by dashed lines for illustrative purposes only), which may comprise separate displays or a single display programmed to exhibit distinct display segments (as with picture-in-picture technology for example.) Base game display segment 162 is configured to exhibit the progress and outcome of a base game played on the gaming device 100. As shown in FIG. 3, base game display segment 162 may be configured to exhibit a video simulation of a mechanical reel-type game. Bonus game display segment 172 is configured to exhibit a bonus game in the first mode and a shared bonus game in the second mode, as described above. Additionally, gaming device display 164 may also include at least one additional game display segment 182 configured to exhibit an amount in a progressive bonus pool or a video image of a player actively using gaming device 100.

Figure 1:
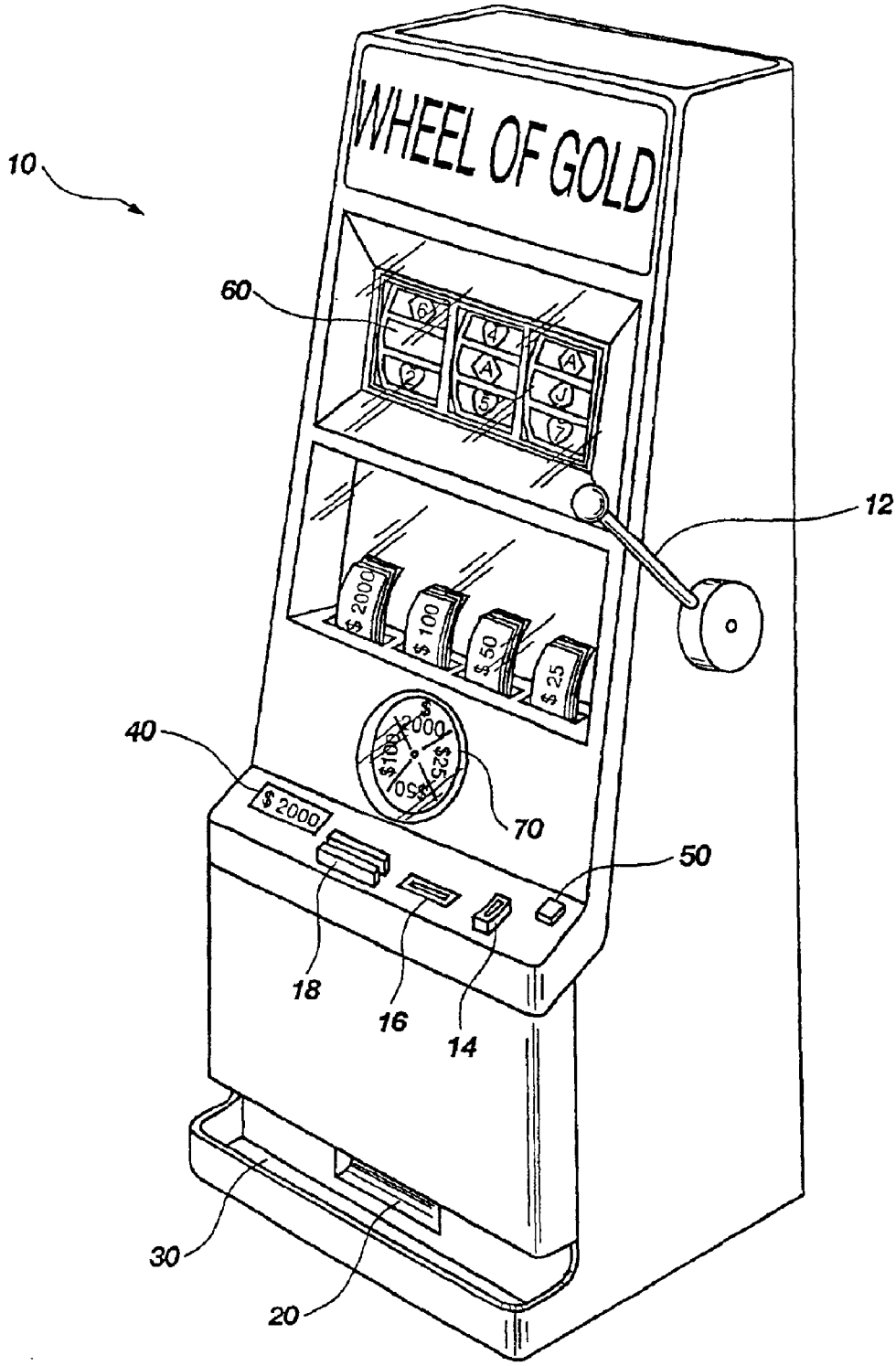
Fig. 1 (PRIOR ART)
FIG. 1 is a perspective view of a prior art electronic gaming device.

Gaming device 100 may include some or all of the features of conventional gaming devices 10 as described above with respect to FIG. 1, modified and augmented as set forth herein. Specifically, and as depicted in FIG. 2, gaming device 100 may include a base game actuator 112, a coin slot 114, a card reader slot 118, a coin chute 120, a coupon reader slot 122, a coupon printer slot 124, a coin trough 130, a credit window 140, and a bonus game actuator 150. The random number generator discussed above may be in the form of a microprocessor such as a central processing unit (CPU) and gaming device 100 may include a memory device electrically connected to the microprocessor. The memory device may be configured to electronically store game parameters and par sheets for the base game, bonus game and shared bonus game. Gaming device 100 may be in the form of a personal computer or may also be configured as a terminal configured to enable communication by a player with another remote device, such as a server, on which the base game may actually be played. In such an instance, gaming device 100 may comprise a personal digital assistant (PDA), a hand-held terminal for hard-wired or wireless communication, or any other suitable device known in the art.

Figure 4:
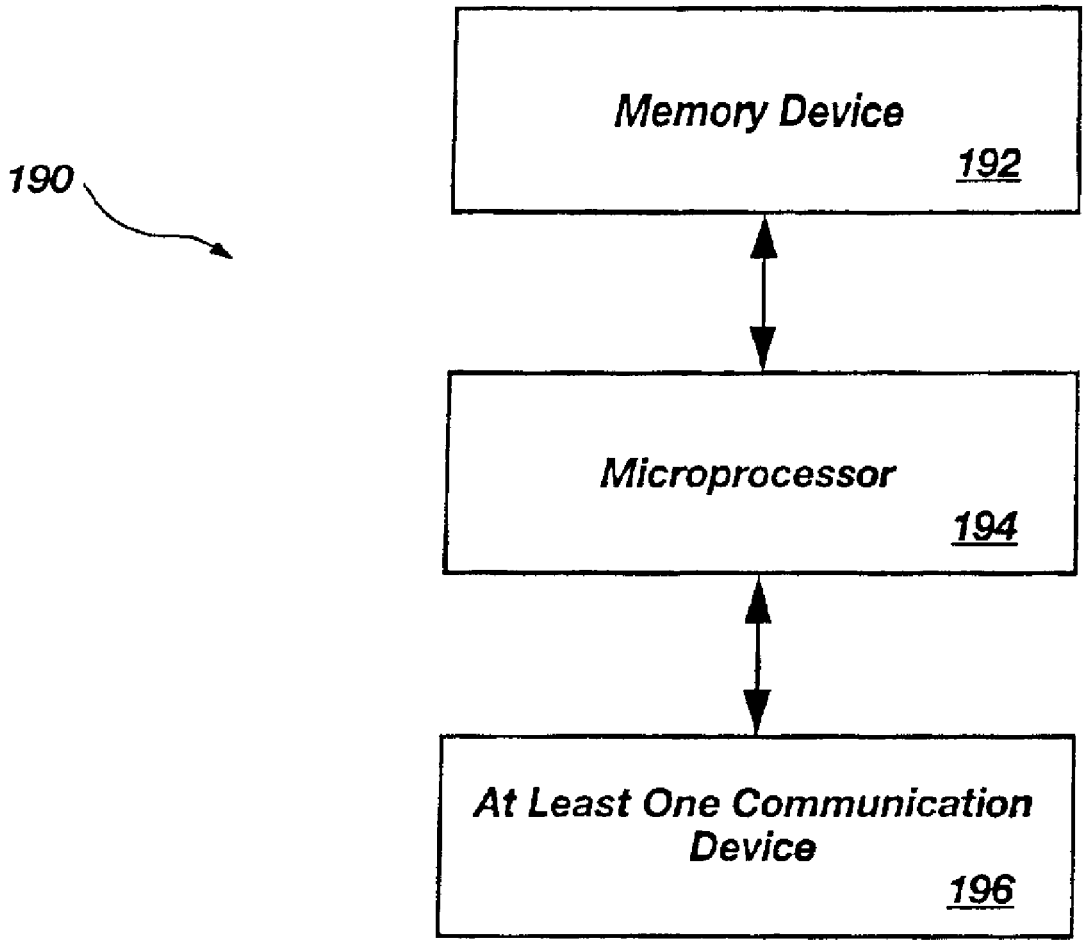
FIG. 4 is a block diagram of a controller for competitive and collaborative gaming according to the present invention.

FIG. 4 is a block diagram of a controller 190 according to the present invention suitable for enabling competitive and collaborative play in a shared bonus game. Controller 190 includes a memory device 192, a microprocessor 194 electrically connected to the memory device 192 and at least one communication device 196 electrically connected to the microprocessor 194. The memory device 192 is configured to electronically store parameters for the shared bonus game, a plurality of entries for the bonus game and a par sheet for the shared bonus game. The microprocessor 194 is configured to execute a shared bonus game for at least one external gaming device (not shown in FIG. 4), such as the gaming device 100 as described in relation to FIG. 2 and FIG. 3 above, electrically connected to controller 190 through the at least one communication device 196. The controller 190 is configured to interface, either directly or indirectly, to peripheral devices to provide indication of the shared bonus game's activity. An example of a peripheral device may be a primary bonus game indicator as discussed below in relation to FIG. 5. The controller 190 may include a random number generator. The controller 190 may be in the form of a personal computer and may include a display device such as a computer monitor.

The at least one communication device 196 may comprise a modem or network card, as is known in the art, which is configured to communicate with the at least one external gaming device directly or indirectly (such as via an Internet Service Provider (ISP) through the Internet.) The at least one communication device 196 may also be configured to communicate with an external player tracking system (not shown). Further appreciation of the capabilities and configuration of controller 190, as well as gaming device 100, will be obtained in the discussion of FIG. 5 through FIG. 7 below.

Figure 5:
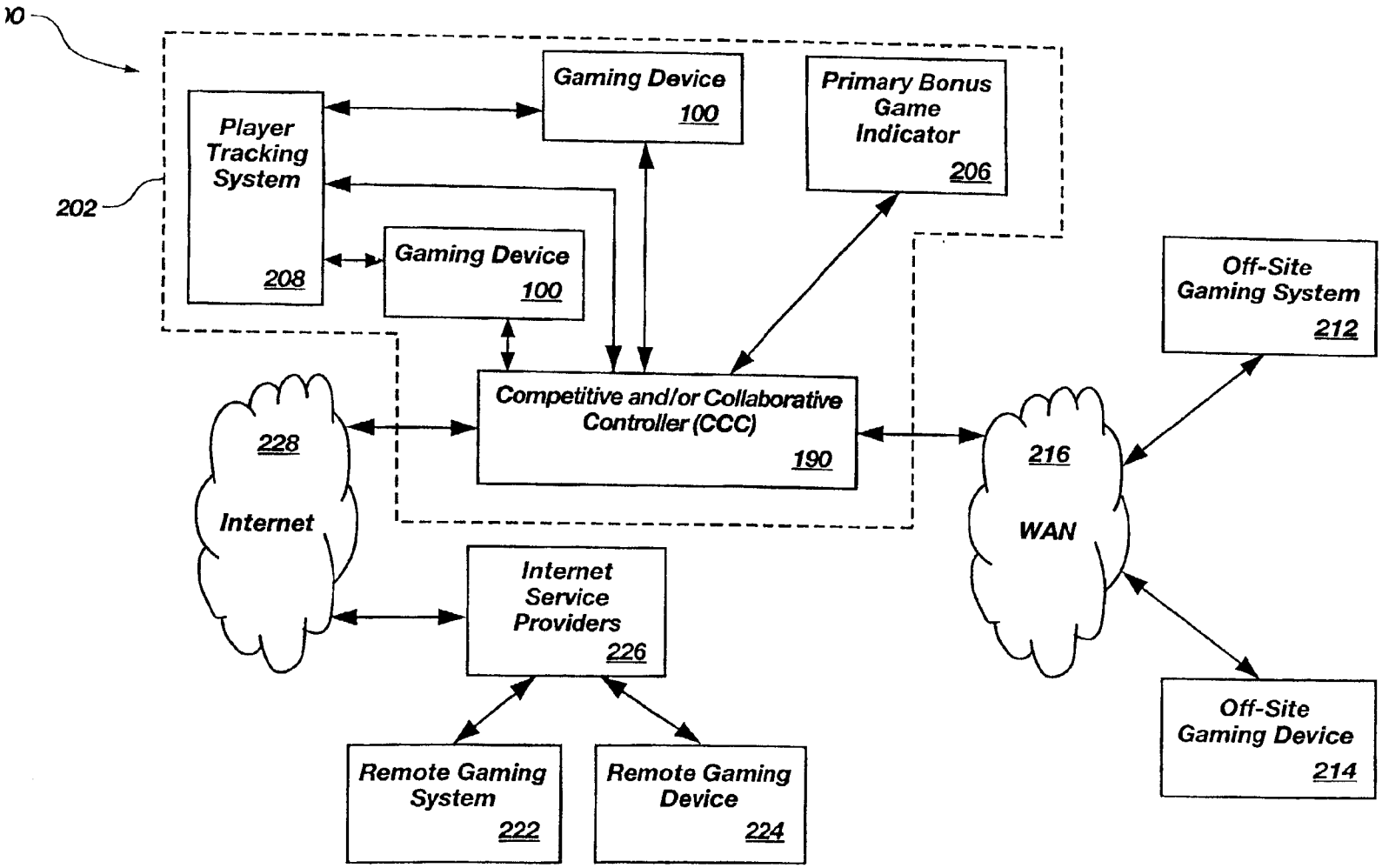
FIG. 5 is a block diagram of a gaming system according to the present invention.

FIG. 5 is block diagram of a gaming system 200 according to the present invention. Gaming system 200 includes an on-site gaming system 202 including a controller 190 for competitive and collaborative gaming, gaming devices 100 (two shown) in communication with the controller 190 and a primary bonus game indicator 206, also in communication with the controller 190. On-site gaming system 202 may also include a player tracking system 208 in communication with the controller 190 and each gaming device 100. The player tracking system 208 may provide the controller 190 with relevant player information including, but not limited to, player name, current gaming activity and past gaming activity. Gaming activity information may include number of games played, amount wagered on each game, credits earned by the player, awards made to the player and specific gaming devices 100 used. Alternatively, the controller 190 may be configured to perform the functions of the player tracking system 208.

In one embodiment of the present invention, the controller 190, gaming devices 100, primary bonus game indicator 206 and player tracking system 208 comprise a local area network (LAN) in which at least the gaming devices 100 and primary bonus game indicator 206 are mutually substantially proximate each other as in, for example, a casino or a portion of a casino. Accordingly, a substantial number of gaming devices 100 are visually and/or audibly detectable from any one gaming device 100. Similarly, the primary bonus game indicator 206 is located so as to provide a visual manifestation of a shared bonus game to substantially all participants and observers of the shared bonus game. As other people see a player's excitement increase due to participation in the shared bonus game, they may also be motivated to participate. Thus, the primary bonus game indicator 206 may provide indicia of, by way of example and not limited to, names and images of participants in the shared bonus game, a triggering event for the shared bonus game, initiation of the shared bonus game, progress of the shared bonus game, outcome of the shared bonus game and the name and image of the winner of the shared bonus game. In addition, any or all of these indicia may be provided to the bonus game indicator 170 or the at least one additional indicator 180 of FIG. 2 (or, alternatively, the bonus game display segment 172 or the at least one additional game display segment 182 of FIG. 3).

In another embodiment of the present invention also depicted in FIG. 5, on-site gaming system 202 is configured to interface with a wide area network (WAN) 216 in communication with at least one off-site gaming system 212. As an example, off-site gaming system 212, or at least one off-site gaming device (also in communication with WAN 216), may be located in a different part of the casino or within a different casino than the on-site gaming system 202. Thus, WAN 216 may include off-site gaming systems 212 and off-site gaming devices 214 located within casinos in the same geographic area, such as a city or state. Off-site gaming system 212 may be substantially identical to on-site gaming system 202, although the number of gaming devices 100 in each system may vary relative to each other. Off-site gaming device 214 may be substantially identical to gaming device 100. As shown in FIG. 5, controller 190 may interface with WAN 216 using the at least one communication device 196 in FIG. 4, as discussed above.

In yet another embodiment of the present invention, also depicted in FIG. 5, on-site gaming system 202 is configured to interface with the Internet 228 to operate the shared bonus game among at least one remote gaming system 222 also connected to the Internet 228 through Internet service providers (ISPs) 226. It will be recognized that on-site gaming system 202 may also be connected to the Internet 228 via one of the ISPs 226 in communication with the at least one communication device 196 (see FIG. 4 and related discussion above). Thus, on-site gaming system 202 may share bonus games with remote gaming systems 222 and remote gaming devices 224 (also connected to the Internet 228 through ISPs 226) located substantially anywhere in the world. Remote gaming system 222 may be substantially identical to on-site gaming system 202, although the number of gaming devices 100 in each system may vary relative to each other. Remote gaming device 224 may be substantially identical to gaming device 100. Remote gaming device 224 may also be a personal computer located in a private location, such as a private residence.

Figure 6:
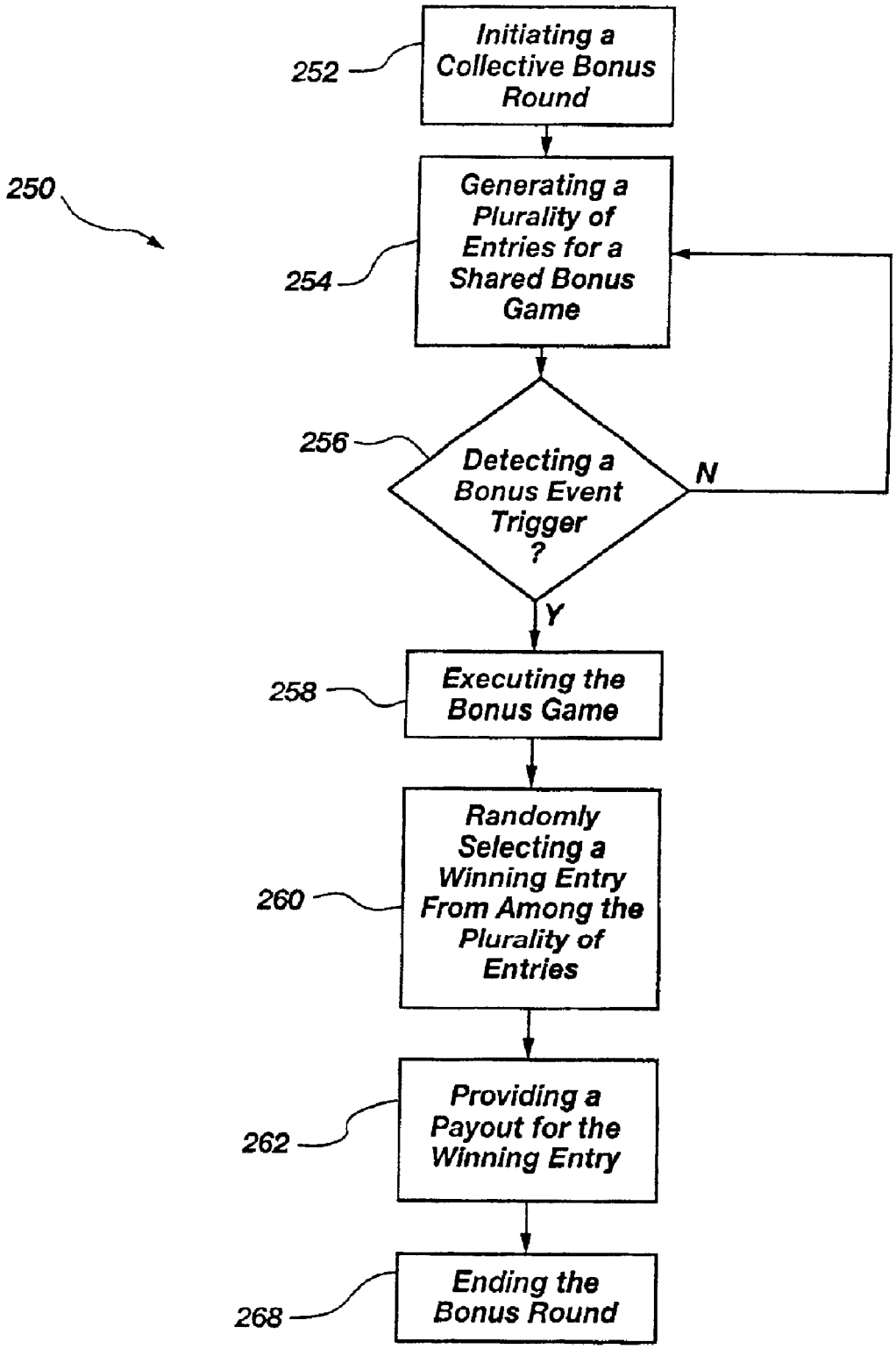
FIG. 6 is a flow chart depicting a method of operating a shared bonus game according to one exemplary embodiment of the invention.

Referring to FIG. 5 and FIG. 6, a method 250 of operating a shared bonus game according to one embodiment of the invention is disclosed. Method 250, while referring specifically to on-site gaming system 202, may apply equally to off-site gaming system 212 and remote gaming system 222. Method 250 includes initiating 252 a collective bonus round, which may include receiving at controller 190 a message from at least one gaming device 100 in communication with the controller 190 indicating that the at least one gaming device 100 has switched from a first mode to a second mode. As used herein, the second mode may also be referred to as a collective bonus round mode. The at least one gaming device 100 may send the message upon being polled by the controller 190.

Method 250 includes generating 254 a plurality of entries for a shared bonus game by at least one gaming device 100 in the collective bonus round mode. The controller 190, tracking activity on each gaming device 100, detects a base game played on the at least one gaming device 100 and determines whether the base game is a "bonus-qualifying base game." A bonus-qualifying base game may be a base game that satisfies any number of qualifying criteria including, but not limited to, initiating the base game using at least a minimum wager, initiating the base game using a maximum wager, generating a qualifying symbol or combination of symbols during the base game, generating a qualifying award during the base game or generating a qualifying combination or accumulation of awards during a plurality of base games.

Upon determining that the base game has resulted in a bonus game qualification, controller 190 creates a current entry for the shared bonus game by assigning a unique code to the qualification event and storing the unique code and entry information in an entry database within the memory device 192 of the controller 190. The entry information may include, but is not limited to, a gaming device identifier, a player identifier (e.g., a player number and name or pseudonym), a qualifying parameters identifier (to account for qualifying base games or other events of different types or having different game parameters) and a time and date identifier.

After assigning and storing the unique code, the controller 190 may categorize the unique code as an authorized unique code if it is determined that the unique code was generated on an authorized gaming device satisfying at least one condition including, but not limited to, at least one of having a player tracking card inserted, having a coupon inserted and producing a minimum number of entries. The minimum number of entries may be current entries generated by the authorized gaming device during a current collective bonus round, or "current bonus round," as well as past entries generated by the current authorized gaming device or another, different authorized gaming device during a time period previous to the current bonus round. Past entries may be introduced into the authorized gaming device by extracting them from a player tracking card or coupon, or by retrieving them from the controller 190. Once the unique code is determined to be an authorized unique code, it is stored along with any past entries in an entry pool. Alternately, the past entries may be distributed among a current entry pool and a plurality of future entry pools according to a bank, or banking, par sheet (as will be discussed in more detail below in relation to FIG. 7).

Method 250 includes detecting 256 a bonus event trigger which includes at least one event detected by the controller 190 including, but not limited to, the initiation 252 of a collective or shared bonus round, the lapse of a predetermined or a random period of time, the accumulation of a predetermined shared bonus game pay amount in a progressive jackpot, the detection of a predetermined number of entries for the shared bonus game and the detection of a predetermined number of gaming devices 100 having generated at least one entry for the shared bonus game.

Method 250 includes executing 258 the shared bonus game, which may include providing a visible manifestation of the shared bonus game as described above, initiating the shared bonus game and determining an outcome of the shared bonus game. Initiating the shared bonus game 252 may include prompting a player corresponding to the gaming device 100 which caused the shared bonus game trigger to initiate the shared bonus game. The prompt may be indicated on the primary bonus game indicator 206, one of the indicators 160, 170, 180 (or alternately, display segments 162, 172, 182) of the gaming device 100 as described above, or both. The player may initiate the bonus game by activating the bonus game actuator 150. Determining an outcome of the shared bonus game randomly may include selecting a payout amount, which may either be consistent with or in excess of a base game par sheet used to provide a base game payout.

Method 250 includes randomly selecting 260 a winning entry from among the entries in the current entry pool and providing 262 the payout randomly selected above for the winning entry corresponding to the gaming device 100 having generated (current entry) or reintroduced (past entry) the winning entry. The payout may be electronically transferred to the gaming device 100 corresponding to the winning entry. At this point, the bonus round ends 268.

An advantage of method 250 is that it allows the shared bonus event to be integral to the par sheet of each gaming device 100. Players who play faster will have more entries in the entry pool, but they will have made a larger investment than slower players, thus maintaining the percentage payback for all players. For example, if a first player has 30 entries and a second player has 15 entries, the first player is twice as likely to win the shared bonus game. However, the first player would be paid twice as much as the second player for a win. Thus, both players have the same percentage payback. Additionally, the controller 190 may be configured to provide shared bonus game payouts in excess of the base game payout as defined by the gaming device's 100 par sheet by having the ability to qualify and pay players proportionate to their play.

Another advantage of method 250 is that, while maintaining the shared bonus payout consistent with the base game par sheet, a higher percentage of the total payback (e.g., base game payout plus shared bonus game payout) can be distributed to a player from the shared bonus game, adding a significant amount of entertainment to the gaming experience. For example, an original (unshared) average bonus game payout of sixty coins can be increased to a new average of 240 coins by reducing the frequency of the bonus game in a shared bonus game to one quarter of the original frequency while keeping the same level of funding of the bonus game, i.e., paying out the same percentage of wagers made in play of the base games. However, it is significant to note the advantage of sharing the bonus game among a plurality of players. Referring to the present example, a player would participate in the new shared bonus game averaging a 240 coin payout twice as often as the original bonus game averaging 60 coins if the total number of participating players in the bonus game is increased from one to eight by employing the shared bonus game format of the present invention. Thus, while winning a shared bonus game according to the invention may be less frequent, the frequency of participation as well as the award when the shared bonus game is won are both increased significantly.

Figure 7:
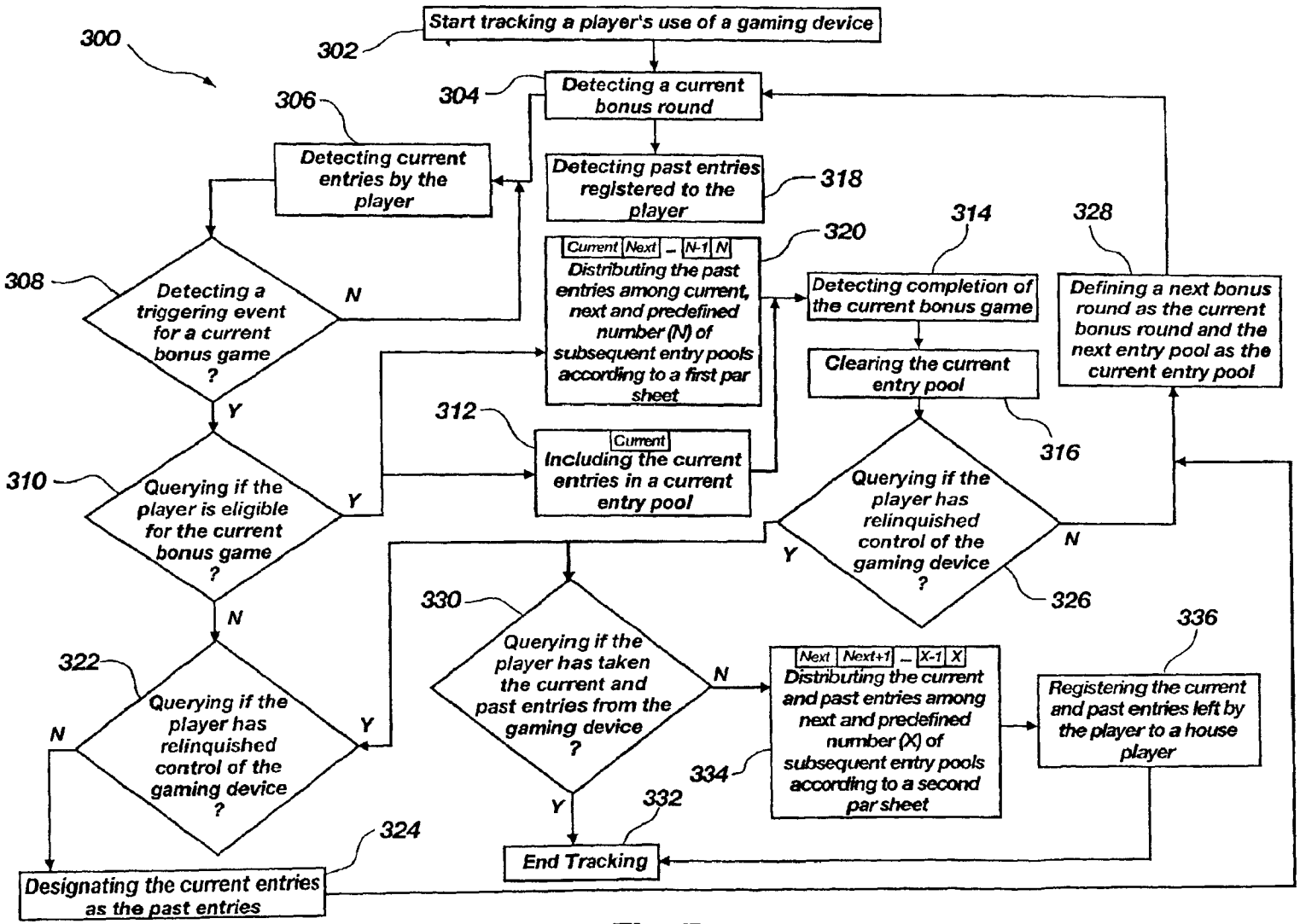
FIG. 7 is a flow chart depicting a method of tracking a player's participation in a plurality of bonus games shared among a plurality of players according to another exemplary embodiment of the invention.

FIG. 7 is a flow chart depicting a method 300 of tracking a player's participation in a plurality of bonus games shared among a plurality of players in gaming system 200. Method 300 includes tracking 302 a player's use of a gaming device 100, detecting a current bonus round 304, detecting current entries by the player 306 using the gaming device during the current bonus round, detecting a triggering event 308 indicating the start of a current bonus game of the plurality of bonus games, querying if the player is eligible to participate in the current bonus game 310, if yes, including the current entries in a current entry pool 312, detecting completion of the current bonus game 314 and clearing the current entry pool 316.

Method 300 may include detecting past entries registered to the player 318. Detecting past entries may include detecting entries generated by the player during a previous bonus round which were taken by the player from the gaming system and reintroduced by the player into the gaming system through a gaming device during the current bonus round. For the case where the player is eligible to participate in the current bonus game 310, the past entries may be distributed among the current entry pool, a next entry pool and a predefined number (N) of subsequent entry pools according to a first par sheet 320. The first par sheet may be a banking (or banked) par sheet. The first par sheet may be configured to maintain the percentage payback substantially consistent with the base game par sheet of gaming device 100. For the case where the player fails to be eligible to participate in the current bonus game 310, querying if the player has relinquished control of the gaming device 322 and, if no, designating the current entries as past entries 324.

Method 300 may further include, after clearing the current entry pool at 316, querying if the player has relinquished control of the gaming device 326 and, if no, defining a next bonus round as the current bonus round and the next entry pool as the current entry pool 328. For the case where the player has relinquished control of the gaming device at 326 or 322, the method may include querying if the player has taken the current and past entries from the gaming device 330 and, if yes, end tracking 332. For the case where the player has not taken the current and past entries from the gaming device at 330, the method may include distributing the current and past entries among the next entry pool and a predefined number (X) of subsequent entry pools according to a second par sheet 334, registering the current and past entries left by the player to a house player 336 and end tracking 332. The second par sheet may be identical to the first par sheet. Thus, method 300 may maintain the percentage payback of gaming device 100 consistent with its base game par sheet while avoiding vulture-like players who may be seeking to assume ownership of the current and past entries left by the player on the gaming device 100.

Figure 8:
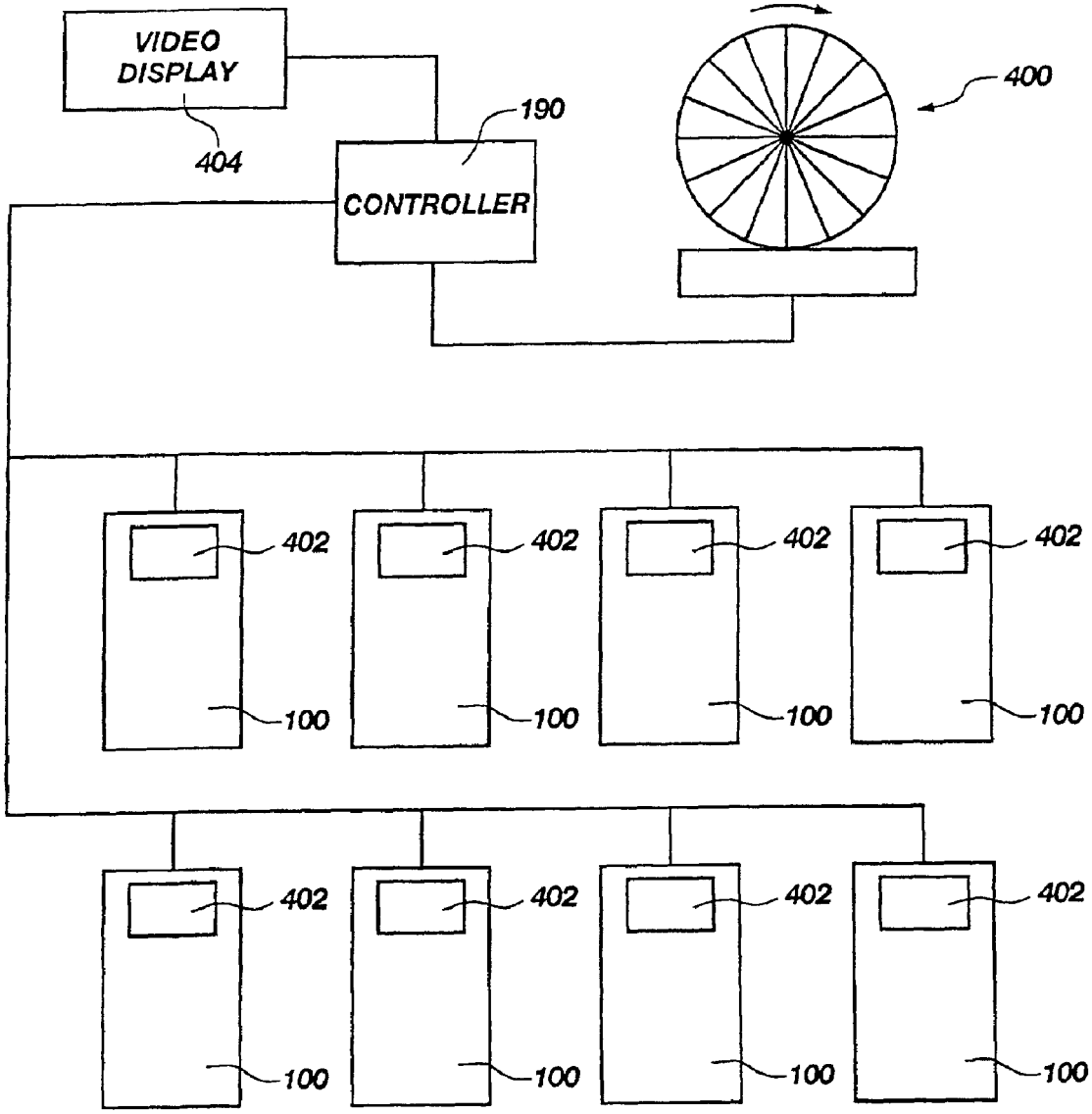
FIG. 8 is a schematic of a bank of networked gaming machines for shared bonus game play according to one exemplary embodiment of the invention.

In a specific example employing a modification of the popular Wheel of Fortune® game according to the '932 and '978 patents to Adams mentioned above, wherein the bonus game is displayed in a so-called "top box" as a rotating wheel above a primary game, the shared bonus game of the present invention will be described with reference to the foregoing disclosure and to FIG. 8 of the drawings. In this exemplary implementation of the shared bonus game, a plurality of gaming devices 100 arranged as a bank of gaming devices 100 in a common location are networked to a controller 190 for play of the shared bonus game as described above. Rather than employing a bonus wheel in each top box associated with a primary game incorporated in a gaming device 100 as in conventional Wheel of Fortune® game implementations, a single, preferably larger, bonus wheel 400 is deployed in sight of the gaming devices 100 and, in addition, each gaming device 100 includes an additional graphics display 402 to display bonus game results and, optionally, player images as obtained from cameras 104 as well as a video simulation of the large bonus wheel 400. The same program, same par sheet and base or primary game are employed herein as are conventionally employed in the Wheel of Fortune® games. The base game payouts and bonus payouts for wins on the Wheel of Fortune® bonus game percentage payouts may be identical to those used in executing the conventional Wheel of Fortune® game. As noted above, with a plurality of players sharing the bonus game, each player will be entering the shared bonus game more frequently than in the case of standalone bonus game play as in the conventional Wheel of Fortune® implementation.

If, for example, the conventional standalone Wheel of Fortune® bonus award is 60 coins, by making wheel 400 spin only one quarter as frequently, the awards may be boosted to approximately 240 coins for play of each shared bonus game and, as previously noted, in a bank of eight gaming devices 100, each player participates in the Wheel of Fortune® shared bonus game twice as often as in the conventional, standalone Wheel of Fortune® bonus game.

As players make wagers to initiate base game play and then activate the base game as known in the art, the controller 190 tracks every maximum bet or "max coin in" made on each one of gaming devices 100 for play of each individual round of a base game. The controller 190 assigns a unique identifier to each of such qualified base games to be used as an entry in the shared bonus game. Thus, players that play faster will generate more entries, thus increasing their odds of winning the shared bonus game, but at the cost of a larger investment. As noted above, if one player has 30 entries and another player has 15 entries when the shared bonus game is triggered, the player with 30 entries is twice as likely to win the bonus award, but has wagered twice as much in base game play which qualifies for the shared bonus game.

When any player at a gaming device 100 triggers the shared bonus event by obtaining a Wheel of Fortune® symbol on the third (right-hand) reel of the display for the base game, all the qualified entries or qualified base games are eligible to win the bonus. As additional qualifying criteria, each player at a gaming device 100 may be required to have a player tracking card inserted in his or her gaming device 100. Any qualified players playing uncompleted base games at the time the shared bonus mode is triggered are permitted to finish play of the last-initiated base game, after which their gaming machines 100 enter a stand by mode, in anticipation of the shared bonus game. When the qualified players have completed their base games, the player whose gaming machine 100 triggered the shared bonus mode is enabled to activate the shared bonus game by manipulating an input element, for example, pressing a button, on his or her gaming machine 100. To stimulate interest in the shared bonus game, upon a gaming machine 100 triggering same, audio and visual effects such as a drumroll and flashing lights on each qualified gaming machine 100 as well as on a large wheel 400. The gaming machine triggering the shared bonus game may exhibit additional special effects. A choreographed, short (for example, five to ten second) pre-spin of the wheel show on gaming machines 100 and wheel 400 is contemplated. As noted above, the shared bonus game may be initiated in any one of a number of ways The controller 190 tracks which player triggered the shared bonus game by identification of the gaming device 100 and player tracking card and prompts that player to spin the wheel 400 using a player input element such as a large "SPIN THE WHEEL" button on the housing of his or her gaming device 100. All other gaming devices 100 which have qualified for bonus play are notified on their display 402 that they are participating in the shared bonus game. The video camera 104 at each gaming device may be used to film the players that are actively involved (participating in) the shared bonus game and display live video clips of each player in sequence, at random or according to a preprogrammed order on a large video display 404 visible from player positions at the bank of gaming devices 100 and to the public at large in the casino. When the wheel 400 spins and lands on an award amount, there is an attendant audio output, such as a drumroll. During play of the shared bonus game, a random number generator associated with wheel 400 randomly selects among the various possible wheel pay distributions and arrives at an outcome.

Before, concurrently with, or subsequent to the spin of the wheel 400, controller 190 randomly draws an entry from the total combined pool of entries associated with all qualified base games and awards the bonus to the gaming device 100 (and player) associated with the winning entry, which may also be characterized as a "raffle ticket," the determination of the winning player being implemented as a random drawing, or raffle. Players with more entries or raffle tickets have a higher probability of winning the bonus award, but receive the same return or payback on their investment in base game play as players with fewer entries, due to their greater investment in base game play to obtain the additional entries.

As noted previously, when the payback percentage of the bonus game is integral to the base game par sheet or paytable, unqualified game raffles accrued but not entered (due to a gaming device 100 being idle at the time of the shared bonus game) may be distributed randomly into subsequent bonus events over a selected number X of subsequent shared bonus games. The randomly distributed accrued raffle tickets or entries may always be associated with the gaming device on which the raffle tickets were accrued. As noted above, it is desirable to thwart vulture-like players by throwing the unused entries into a pool and randomly (fully or partially) adding them back into subsequent shared bonus games. Alternatively, a player may remove the entries or raffle tickets by transferring them to a player tracking card or by generating a coupon at the gaming device 100, the card or coupon then being reinserted in the same or another gaming device 100 of the bank at a later time. However, if an entry or raffle ticket is usable on another gaming device, it should be recognized that this would skew the par sheet for the original gaming device 100 on which the entry or raffle ticket was earned. To address this issue, a "bank" par sheet for the bank of networked games would be needed. In other words, the bank of gaming devices 100 would be treated under a single, umbrella par sheet. If the bonus awards were from a progressive pool above (separate from) the base game par sheet, this would facilitate removal of the raffle tickets or entries by the player, or banking them with the casino in a player tracking system.

It should be noted that a combination of base, bonus and shared bonus games on gaming devices may be implemented using networked gaming devices as described above, so that both standalone bonus games and shared bonus games may be offered in combination with base game play on a gaming device. In such an event, different trigger events may be used to enable either a standalone bonus game or a shared bonus game. Furthermore, each standalone bonus game may be used to randomly enable a winner thereof for play on a shared bonus game, in lieu of or in addition to qualifying players for shared bonus game play directly on the base game.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents and alternatives falling within the spirit and scope of the invention as defined by the following appended claims.

What is claimed is:

1. A method of tracking a player's participation in a plurality of bonus games shared among a plurality of players in a gaming system which randomly selects a winning entry registered to a winning player from a current entry pool, said method comprising:

detecting said player's use of a gaming device in communication with said gaming system;

detecting a current bonus round;

detecting current entries generated by said player using said gaming device during said current bonus round;

detecting past entries registered to said player;

detecting a triggering event indicating a start of a current bonus game of said plurality of bonus games;

querying if said player is eligible to participate in said current bonus game;

if said player is eligible to participate in said current bonus game, including said current entries in said current entry pool and distributing said past entries among said current entry pool, a next entry pool and a predefined number of subsequent entry pools according to a first par sheet;

if said player fails to be eligible to participate in said current bonus game, querying if said player has relinquished control of said gaming device and, if no, designating said current entries as said past entries;

detecting completion of said current bonus game; and clearing said current entry pool.

2. The method of claim 1, wherein said detecting current entries generated by said player using said gaming device comprises detecting base games played on said gaming device, said base games satisfying at least one of initiating said base games using at least a minimum price, initiating said base games using a maximum price, generating a qualifying symbol during said base games, generating a qualifying combination of symbols during said base games, generating a qualifying award during said base games and generating a qualifying combination of awards during said base games.

3. The method of claim 1, wherein said querying if said player is eligible to participate in said current bonus game comprises querying whether said player satisfies at least one of inserting a player tracking card into said gaming device, inserting a coupon into said gaming device and generating a minimum number of said current entries using said gaming device.

4. The method of claim 1, wherein said first par sheet is a banking par sheet.

5. The method of claim 1, wherein said detecting past entries further comprises detecting entries generated by said player during a previous bonus round that were taken by said player from said gaming system and reintroduced by said player into said gaming system through said gaming device during said current bonus round.

6. The method of claim 1, if said player has relinquished control of said gaming device, further comprising:

querying if said player has taken said current entries and said past entries from said gaming device;

if no, distributing said current entries and said past entries among said next entry pool and said predefined number of subsequent entry pools according to a second par sheet.

7. The method of claim 6, wherein said second par sheet is identical to said first par sheet.

8. The method of claim 6, further comprising registering to a house player said current entries and said past entries not taken by said player such that, if randomly selected as said winning entry, said house player becomes said winning player.

9. The method of claim 8, wherein said house player comprises an administrator of said bonus games in said gaming system.

10. The method of claim 1, wherein said detecting completion of said current bonus game further comprises:

querying whether said player is said winning player for said current bonus game; and if yes, electronically recording an award transferred to said player.

11. The method of claim 1, further comprising defining a next bonus round as said current bonus round and repeating the method acts as recited in claim 1.

12. A system comprising:

a plurality of gaming devices; and a controller including a microprocessor and memory, the controller being in communication with the plurality of gaming devices, the controller programmed to detect a player at one of said plurality of gaming devices, said player using said one of said plurality of gaming devices;

the controller programmed to detect a current bonus round;

the controller programmed to detect current entries generated by said player using said one of said plurality of gaming devices during said current bonus round;

the controller programmed to detect past entries registered to said player;

the controller programmed to detect a triggering event indicating a start of a current bonus game of a plurality of bonus games;

the controller programmed to query if said player is eligible to participate in said current bonus game;

the controller programmed, if said player is eligible to participate in said current bonus game, to include said current entries in a current entry pool and distributing said past entries among said current entry pool, a next entry pool and a predefined number of subsequent entry pools according to a first par sheet;

the controller programmed, if said player fails to be eligible to participate in said current bonus game, to query if said player has relinquished control of said gaming device and, if no, to designate said current entries as said past entries;

the controller programmed to detect completion of said current bonus game; and the controller programmed to clear said current entry pool.

13. The system of claim 12, wherein the controller is programmed to detect base games played on said one of said plurality of gaming devices to detect said current entries, said base games satisfying at least one of initiating said base games using at least a minimum price, initiating said base games using a maximum price, generating a qualifying symbol during said base games, generating a qualifying combination of symbols during said base games, generating a qualifying award during said base games and generating a qualifying combination of awards during said base games.

14. The system of claim 12, wherein the controller is programmed to query whether said player satisfies at least one of inserting a player tracking card into said one of said plurality of gaming devices, inserting a coupon into said one of said plurality of gaming devices and generating a minimum number of said current entries using said one of said plurality of gaming devices to query if said player is eligible to participate in said current bonus game.

15. The system of claim 12, wherein said first par sheet is a banking par sheet.

16. The system of claim 16, wherein the controller is programmed to detect entries generated by said player during a previous bonus round that were taken by said player from said gaming system and reintroduced by said player into said gaming system through said one of said plurality of gaming devices during said current bonus round.

17. The system of claim 12, the controller is programmed, if said player has relinquished control of said one of said plurality of gaming devices, to:

query if said player has taken said current entries and said past entries from said one of said plurality of gaming devices; and if no, distribute said current entries and said past entries among said next entry pool and said predefined number of subsequent entry pools according to a second par sheet.

18. The system of claim 17, wherein said second par sheet is identical to said first par sheet.

19. The system of claim 17, the controller is programmed to register to a house player said current entries and said past entries not taken by said player such that, if randomly selected as said winning entry, said house player becomes said winning player.

20. The system of claim 19, wherein said house player comprises an administrator of said bonus games in said gaming system.

21. The system of claim 12, the controller is programmed to:

query whether said player is said winning player for said current bonus game; and if yes, electronically record an award transferred to said player.

22. The system of claim 12, the controller is programmed to define a next bonus round as said current bonus round and repeating the program recited in claim 12.

* * * * *